US006182922B1

(12) United States Patent
Kazama

(10) Patent No.: US 6,182,922 B1
(45) Date of Patent: Feb. 6, 2001

(54) REASSEMBLABLE REEL AND DISASSEMBLY DEVICE

(75) Inventor: Hitoshi Kazama, Saitama Pref. (JP)

(73) Assignee: Toyo Jushi Co., Ltd. (JP)

( * ) Notice: Under 35 U.S.C. 154(b), the term of this patent shall be extended for 0 days.

(21) Appl. No.: 09/165,835

(22) Filed: Oct. 2, 1998

(30) Foreign Application Priority Data

Oct. 4, 1997 (JP) ..... 9-287855
Feb. 23, 1998 (JP) ..... 10-057519

(51) Int. Cl.[7] ..... B65H 75/14; B65H 75/18; B65H 75/08

(52) U.S. Cl. ..... 242/608.6; 242/609.1; 242/613

(58) Field of Search ..... 242/608, 608.2, 242/608.6, 608.7, 609, 609.1, 613

(56) References Cited

U.S. PATENT DOCUMENTS 3,288,392 * 11/1966 Goldberg ..... 242/608.2 X
3,861,614 * 1/1975 Horak ..... 242/608.2
4,903,913 * 2/1990 McCaffrey ..... 242/608.6
5,143,316 * 9/1992 Goetz et al. ..... 242/608.6 X
5,531,399 * 7/1996 Weisburn et al. ..... 242/608.6
5,575,437 * 11/1996 Campbell ..... 242/609.1 X
5,676,332 * 10/1997 Kraus et al. ..... 242/608.6
5,727,752 * 3/1998 Matsuzoe ..... 242/608.6
5,775,634 * 7/1998 Fettes et al. ..... 242/608.6

FOREIGN PATENT DOCUMENTS

411978 * 2/1991 (EP) ..... 242/608.6
2759177 3/1998 (JP) .
2796963 7/1998 (JP) .
2808440 7/1998 (JP) .
2810707 7/1998 (JP) .

* cited by examiner

*Primary Examiner*—Donald P. Walsh
*Assistant Examiner*—William A. Rivera
(74) *Attorney, Agent, or Firm*—Oldham & Oldham Co., L.P.A.

(57) ABSTRACT

A reassemblable reel which can easily be assembled and has a capacity as well as strength sufficient to contain and protect a great quantity of chips or other electronic components when in use and, after use, can easily be disassembled into compact parts which are easy to transport. The reassemblable reel generally includes two flanges and a reel hub having flexible plates formed therein. Each flexible plate is provided with tooth-shaped protrusions formed on the front and back ends of the flexible plate. The reel is so designed as to be formed by bringing the flanges into contact with both ends of the reel hub and pushing the flanges to engage the flexible plates with the tooth-shaped protrusions in stopper portions formed in the flanges. The tooth-shaped protrusions of each flexible plate can be disengaged by pushing the flexible plate from the outside of either flange in such a direction as to disengage the tooth-shaped protrusions. A disassemble device including key bars is selectively used to push the flexible plates in such a direction as to disengage their tooth-shaped protrusions. The key bars are removably inserted into through holes formed in the flanges. An abutment piece may also be provided with the disassembly device, positioned to correspond to the center cylinder of the reel hub.

7 Claims, 11 Drawing Sheets

REASSEMBLABLE REEL AND DISASSEMBLY DEVICE

FIELD OF THE INVENTION

The present invention relates to a reassemblable reel and a disassembly device.

PRIOR ART

Conventionally, when storing and transporting electronic components such as semiconductor chips, it is a common practice to set electronic components in indentations formed in a plastic tape or the like, cover the parts with a covering tape or the like and then wind the plastic tape around a reel. Examples of such art are disclosed in Japanese Utility Model Public Disclosure Nos. 64851/1984 and 44969/1986.

Other examples include a configuration offered in Japanese Utility Model Public Disclosure No. 33867/1984, which calls for forming a reel in such a manner that two flanges are so disposed as to face each other and joined together by bringing a boss protruding from the center of one of the flanges into contact with another boss protruding from the center of the other flange. In addition, examples of a structure wherein a take-up hub is provided with a conductive layer in order to prevent electrostatic charge are disclosed in Japanese Utility Model Public Disclosure Nos. 137760/1985 and 147657/1987.

When producing a reel having any one of the structures described above, a reel hub, i.e. a winding drum portion, and flange portions are formed separately and securely assembled later. This method, however, requires an extra step in the production process in order to bond the reel hub to the flanges. An example of methods for solving this problem is a reel disclosed in the aforementioned Japanese Utility Model Public Disclosure No. 33861/1984, wherein a raised portion which serves as a reel hub is so formed as to project from each flange and, when assembled, connected to the corresponding raised portion by means of butt joint.

According to the above configuration, the number of parts is only two. However, as no specific location is set for the joining point, it is difficult to join the two parts so as to form a uniform and straight reel hub. Furthermore, as they have to be joined by using a bonding agent or a weld, the bonding operation is extremely troublesome.

In order to overcome these problems, the applicant of the present invention had previously offered a configuration having advantages such that a reel can easily be assembled simply by fitting two members to each other; assembly can easily be done in a short period of time with no need of such other steps as bonding, because a reel hub and a whole flange are formed in an integral body by using a conductive material; and that production costs are very low because it requires only two members (refer to Japanese Utility Model Public Disclosure Nos. 20855/1992 and 20856/1992).

As an increasingly large number of electronic components have been consumed recently, there has arisen a need to store and transport a great amount of conventional electronic components, which is difficult for conventional reels to fully cope with. In order to store a large number of electronic components, there is the need of reels which have a diameter larger than that of conventional reels as well as such a strength that is not possible with reels of the conventional assembled type. Furthermore, because of their high production costs, those large reels have to be used a number of times. A problem that has arisen in this regard involves transportation of empty reels after the use of tapes; as these reels are bulky, transportation costs are high in spite of their lightweight.

Problems to Be Solved by the Invention:

Components and connecting member of a reel with a great diameter require a sufficient strength. In addition, their engagement mechanism, too, has to be strong in order to protect chips or other electronic components to be wound around the reel for storage. However, as tightly engaged parts are usually difficult to disengage, it is difficult to obtain a structure that is easy to assemble and, at the same time, is also easy to disassemble. Furthermore, a reel consisting of two parts presents a problem when it has a large diameter and mass in that its parts tend to be bulky even in the disassembled state.

SUMMARY OF THE INVENTION

In order to solve the above problems, the present invention provides a reassemblable reel which can easily be assembled and has a capacity as well as strength sufficient to contain and protect a great quantity of chips or other electronic components when in use and, after use, can easily be disassembled into compact parts which are easy to transport. To be more specific, a reassemblable reel according to a feature of the invention is comprised of two flanges and a reel hub which includes flexible plates formed therein, wherein each flexible plate is provided with tooth-shaped protrusions respectively formed on the front and back ends of the flexible plate and protruding therefrom; the reel is so designed as to be formed by bringing the flanges into contact with both ends of the reel hub and pushing the flanges so that the elasticity of the flexible plates engages the tooth-shaped protrusions with stopper portions formed in the flanges; and wherein the tooth-shaped protrusions of each flexible plate can be disengaged by pushing the flexible plate from the outside of either flange in such a direction as to disengage the tooth-shaped protrusions. According to the second feature of the invention, a reassemblable reel comprises two flanges and a reel hub which includes flexible plates formed therein, wherein each flexible plate is provided with tooth-shaped protrusions respectively formed on the front and back ends of the flexible plate and protruding therefrom; the reel is so designed as to be formed by bringing the flanges into contact with both ends of the reel hub and pushing the flanges so that the elasticity of the flexible plates engages the tooth-shaped protrusions with stopper portions formed in the flanges; and wherein key bars adapted to push the flexible plates in such a direction as to disengage their tooth-shaped protrusions are so provided as to be removably inserted into through holes formed in the flanges. According to the third feature of the invention, key bars for pushing the flexible plates are formed on a handle portion or a plate body provided at the handle portion so that the key bars extend vertically and correspond to through holes formed in the flanges. According to the fourth feature of the invention, key bars corresponding to through holes formed in the flanges are formed on a handle portion or a plate body provided at the handle portion so that the key bars extend vertically therefrom, and wherein said push-rod has at its end an abutment piece corresponding to the center cylinder of the reel hub, said push-rod disposed in such a manner as to be removably inserted through the handle portion.

PREFERRED EMBODIMENT OF THE INVENTION

Figure 1:
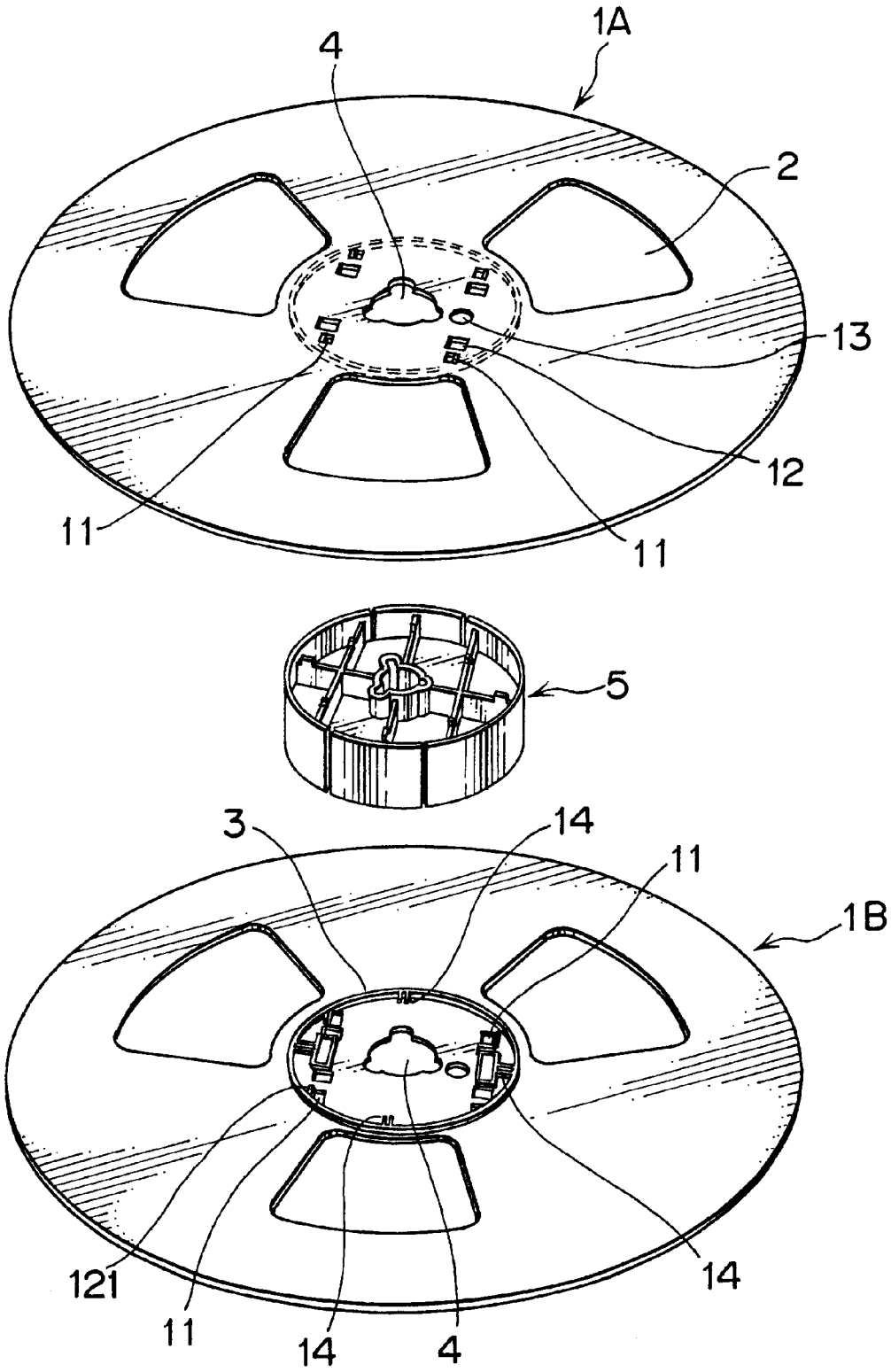
FIG. 1 is an exploded perspective of an embodiment of the present invention.

Next, the present invention is explained in detail hereunder, referring to an embodiment thereof shown in the drawings.

Figure 2:
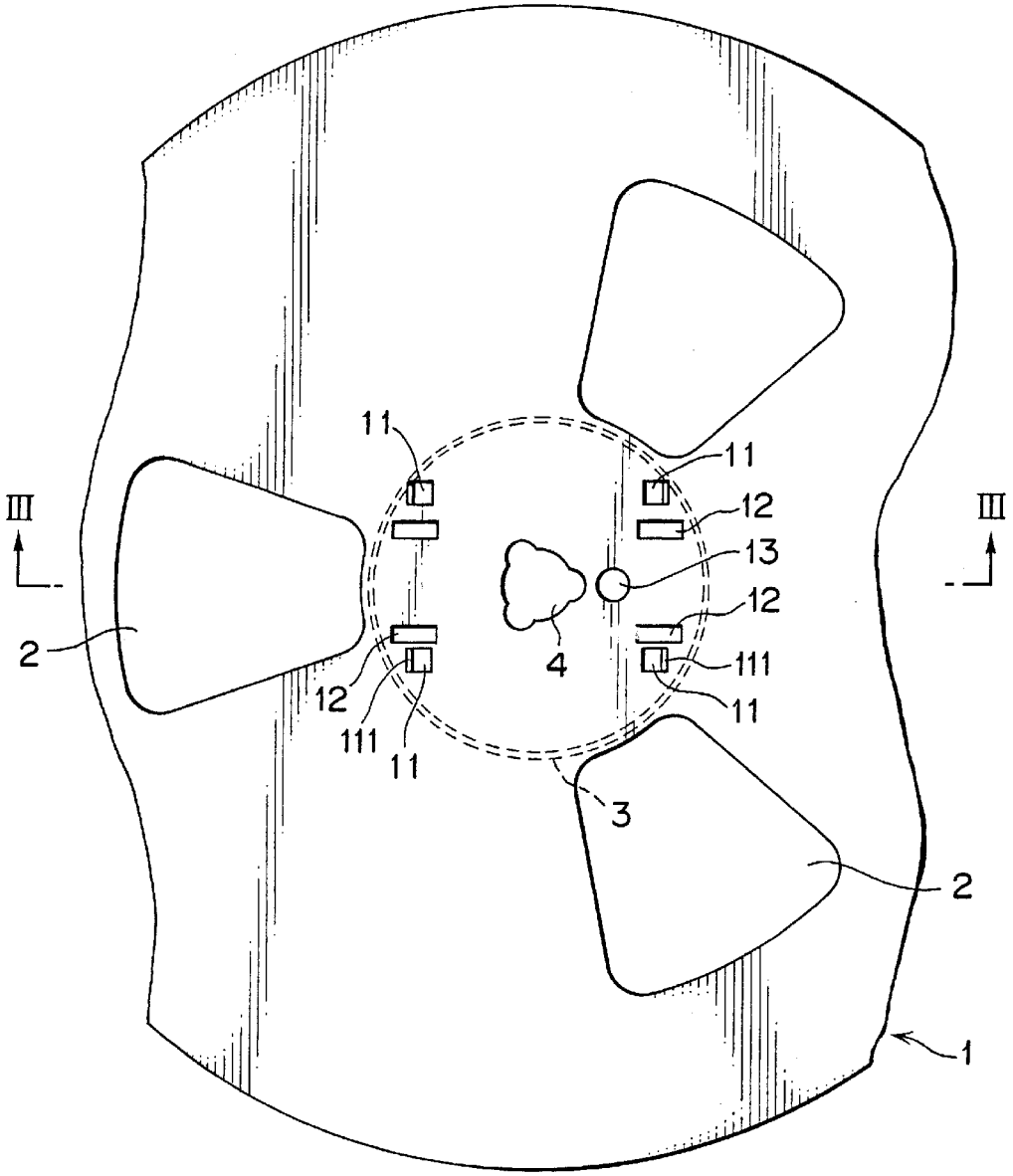
FIG. 2 is a partially enlarged plan of a principal part of a surface of a flange of same.
Figure 3:
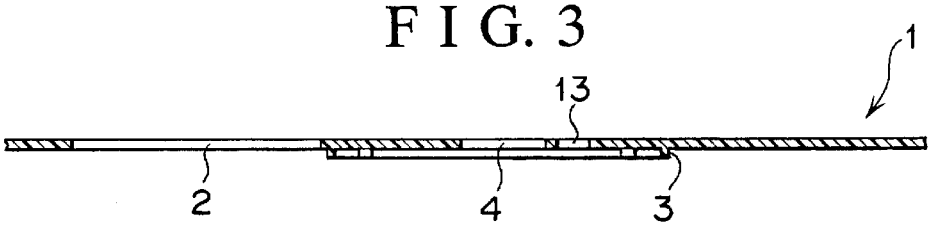
FIG. 3 is a vertical sectional view of FIG. 2 taken along the line III—III.

In the preferred embodiment, a pair of flanges (shown in FIG. 2), comprising of a flange 1A and a flange 1B, are respectively disposed at the front end and back end of the reel and formed of synthetic resin such as polystyrene in essentially flat plates of an identical shape. In cases where the reel will be used for electronic components and has therefore to be conductive, resin mixed with carbon black or the like is normally used to form the flanges. Other examples of materials that may be added include carbon fibers, graphite, titanium fibers or the like. Furthermore, the flanges may be formed of a permanent anti-static material, such as ABS. In order to give it sufficient strength and reduce the weight, each flange may be provided with cutout portions 2, 2, . . . or formed in such a shape that its outer surface looks as if it were made of ribs that are connected to one another. In normal cases, however, its inner surface is essentially smooth.

Numeral 3 denotes a catching portion adapted to catch a reel hub 5 and projects from the central part of the inner surface of each flange 1 by an appropriate distance in order to allow a cylindrical body 51 of the reel hub 5 to fit thereto. Numeral 4 denotes an insertion hole formed at the center of each flange 1 in a desired shape, which may be a circle, a square or a circle with protrusions that are formed at appropriate locations and protrude radially outward.

Numeral 5 denotes a reel hub which comprises a cylindrical body 51 serving as the outer casing, a center cylinder 52 corresponding to the aforementioned insertion holes 4, and ribs 53, 53, . . . that extend between the center cylinder 52 and the outer cylindrical body 51, thereby securing the two cylinders. If it is necessary, a plate rib 54 may be provided in order to secure the cylindrical body 51 and the center cylinder 52 more firmly. The ribs 53 may be formed in a cross-like shape consisting of a rib 531 and a rib 532. 55, 55, . . . represent hollow portions, each of which is defined by a rib 53, the plate rib 54 and the cylindrical body 51. The cylindrical body 51 is provided with cutout portions 511 that are adapted to enable the cylindrical body 51 to shrink. In addition, notches 541 are formed in the plate rib 54, at locations respectively corresponding to the cutout portions 511.

Figure 4:
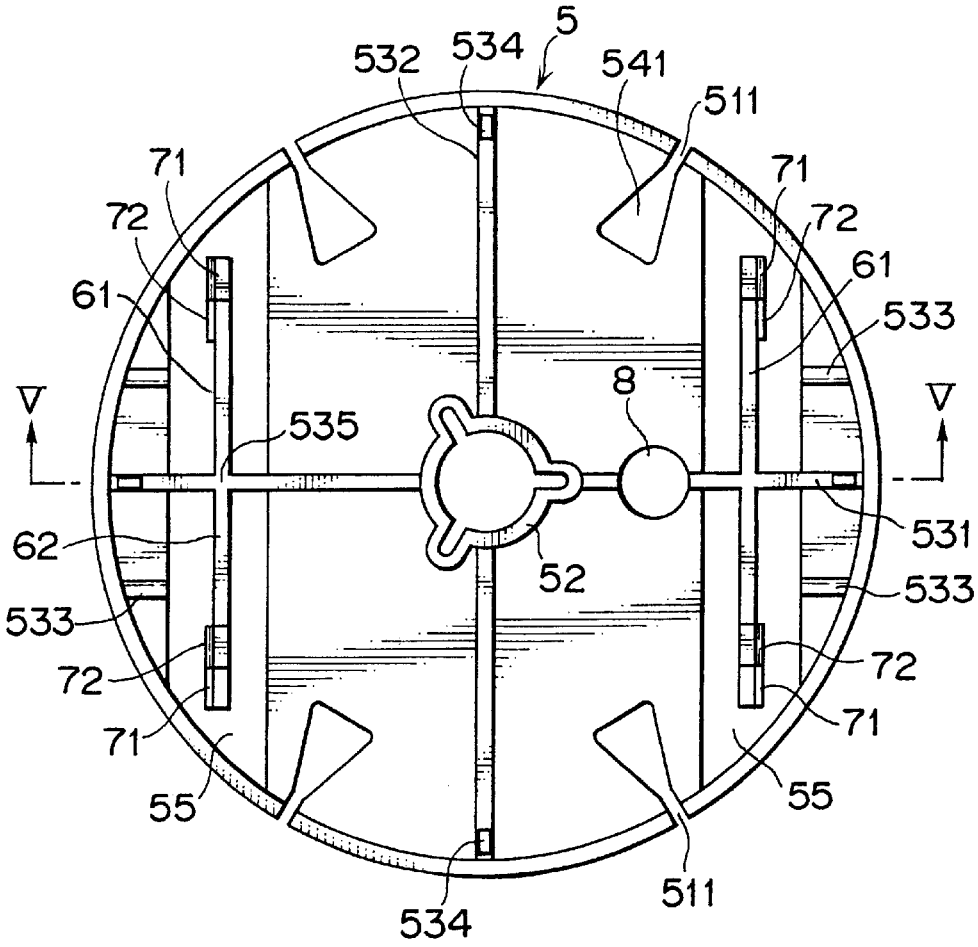
FIG. 4 is a top view of a principal part of the reel hub of same.
Figure 7:
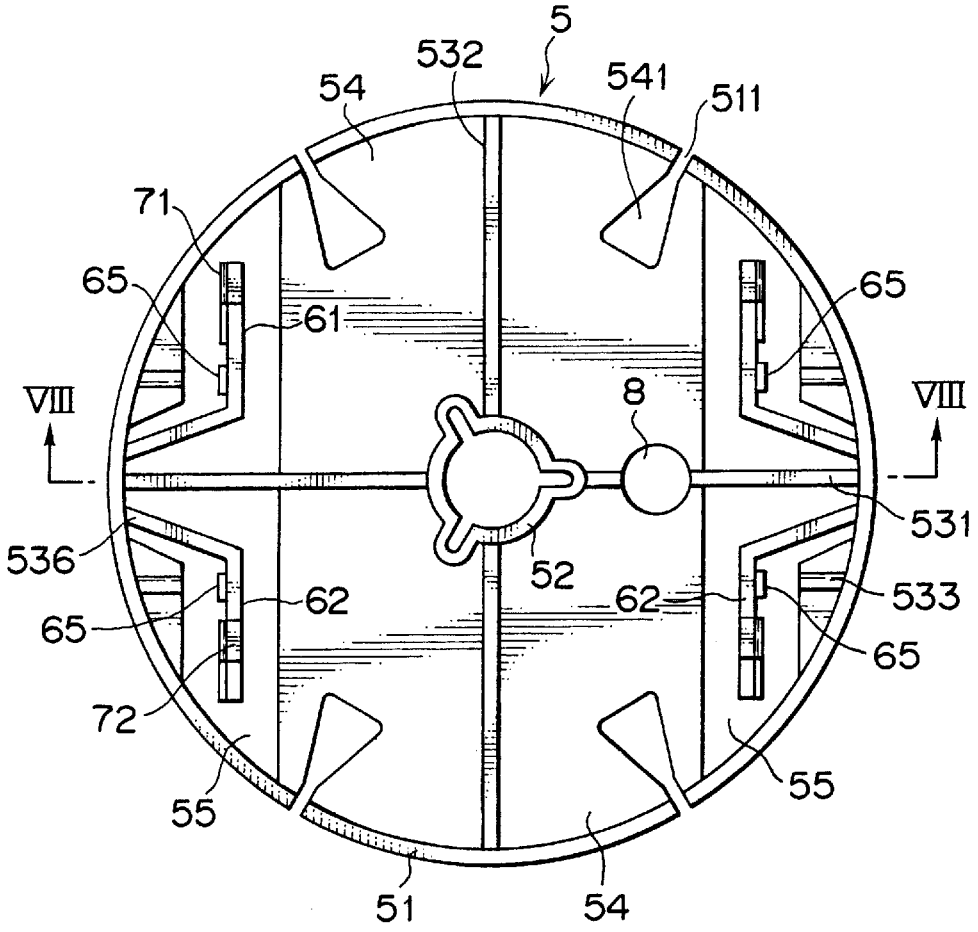
FIG. 7 is a top view of another embodiment of the invention.
Figure 8:
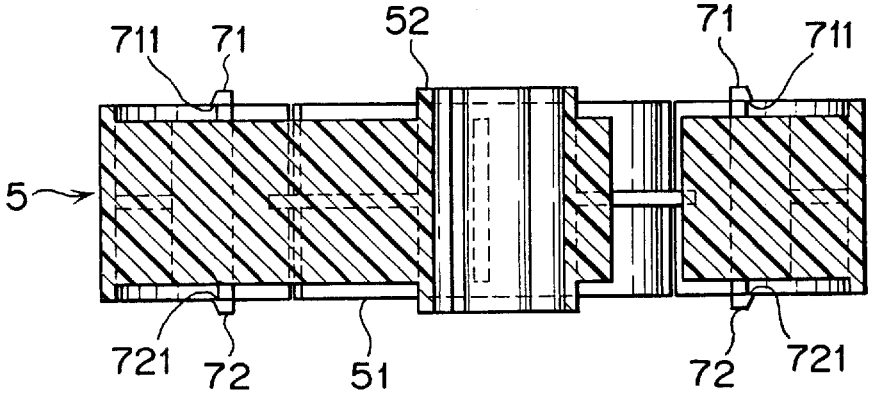
FIG. 8 is a vertical sectional view of FIG. 7 taken along the line VIII—VIII.
Figure 9:
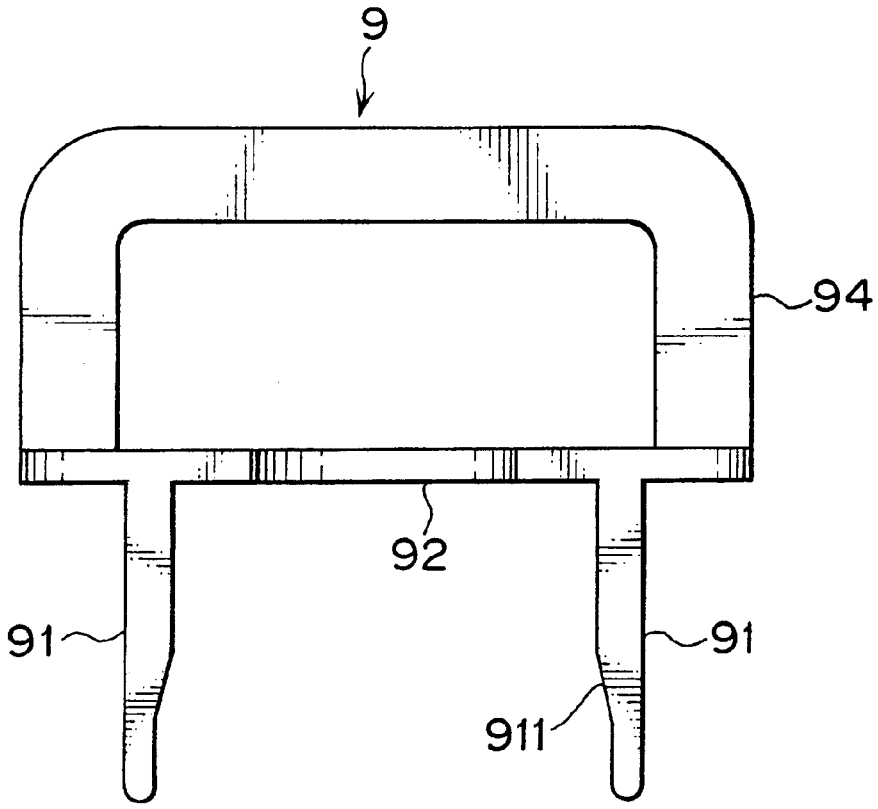
FIG. 9 is a side view of a disassembly device according to the invention.
Figure 10:
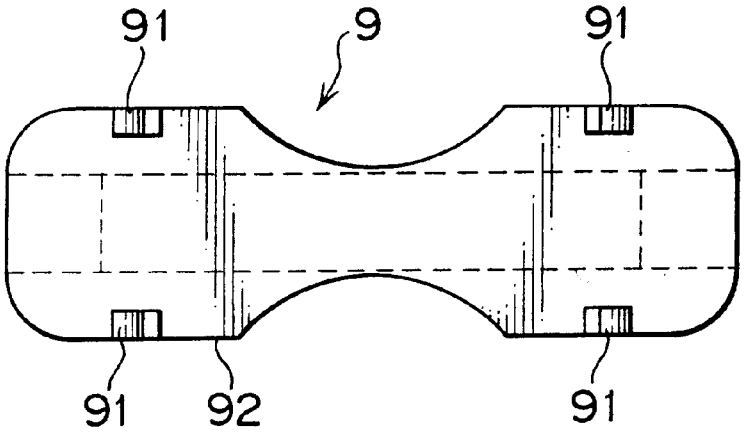
FIG. 10 is a bottom view of said disassembly device.
Figure 11:
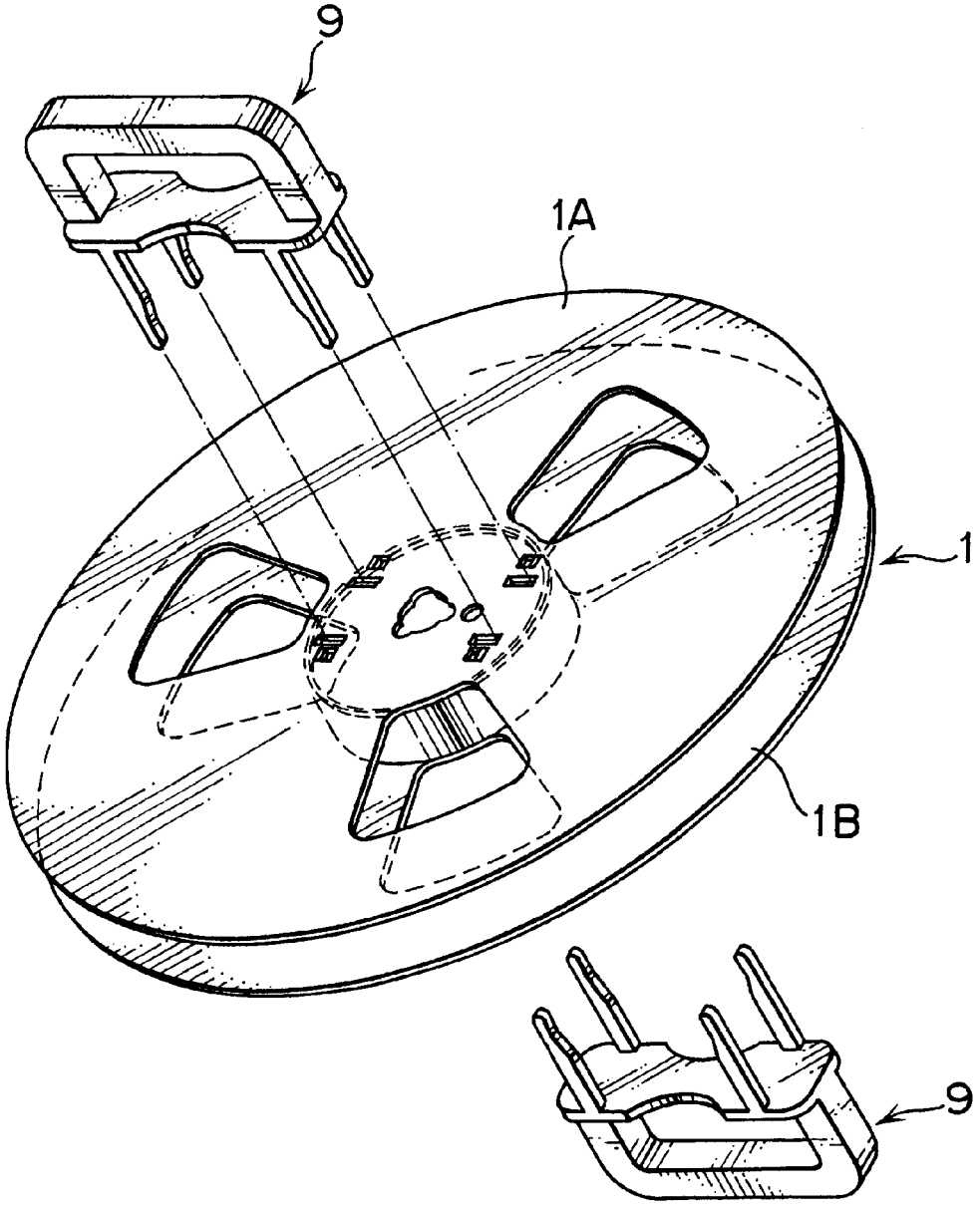
FIG. 11 is a perspective of same in the state when it is in use.
Figure 12:
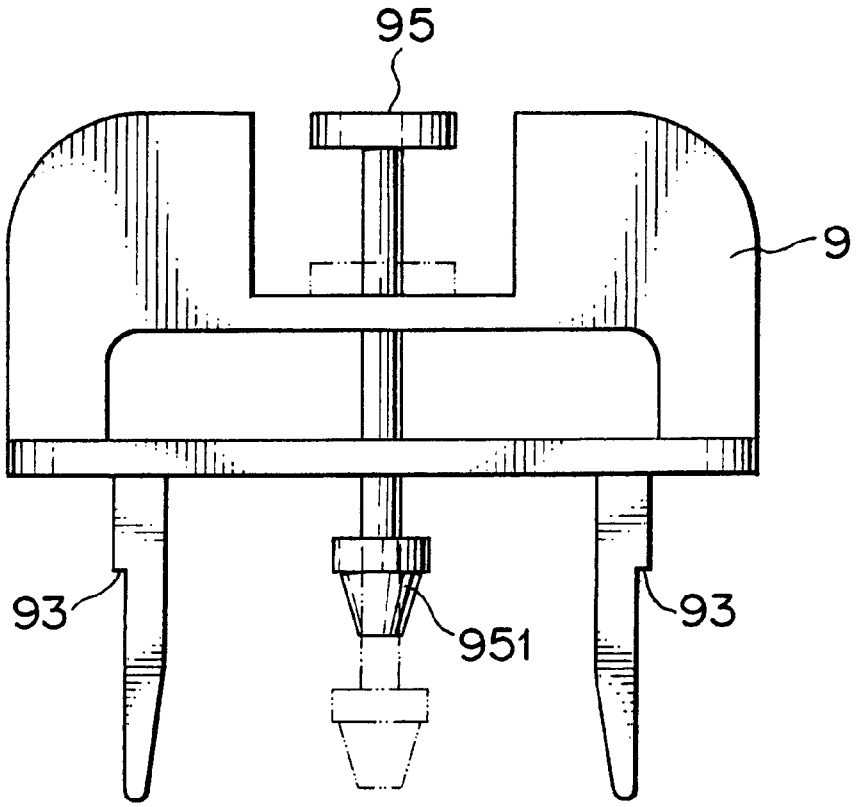
FIG. 12 is a side view of a disassembly device according to another embodiment of the invention.
Figure 13:
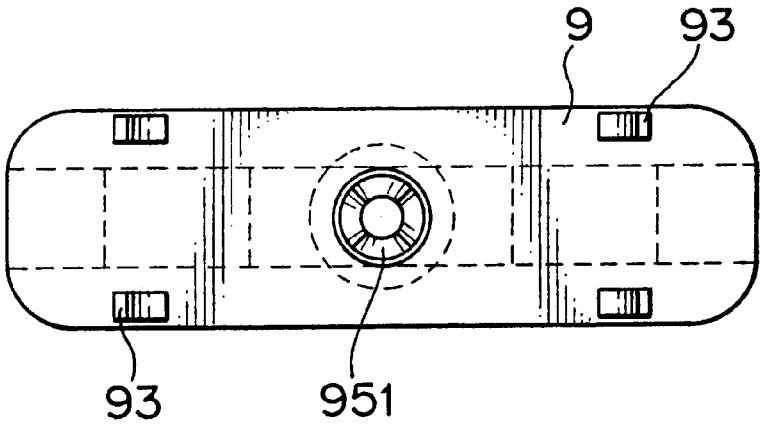
FIG. 13 is a bottom view of same shown in FIG. 12.
Figure 14:
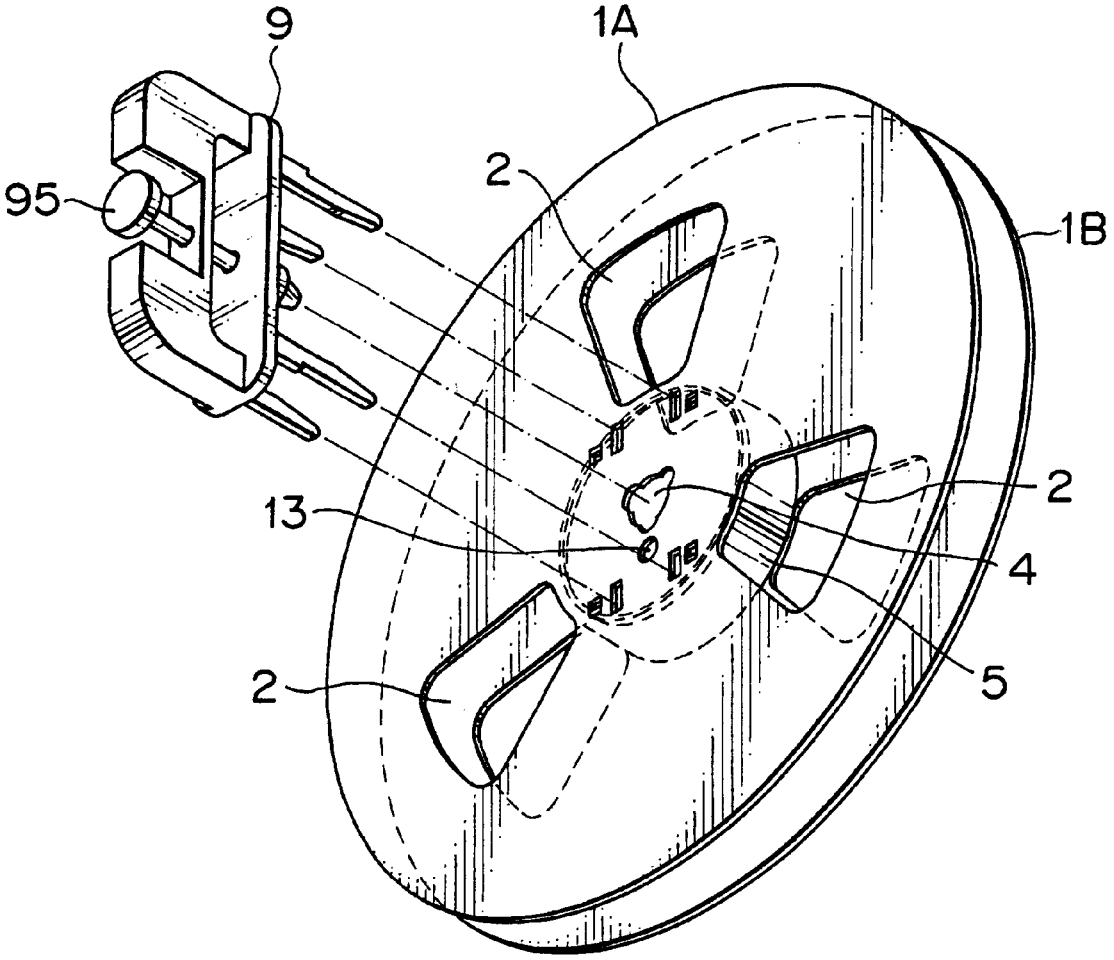
FIG. 14 is a schematic illustration of yet another embodiment of the invention in the state when it is in use.
Figure 15:
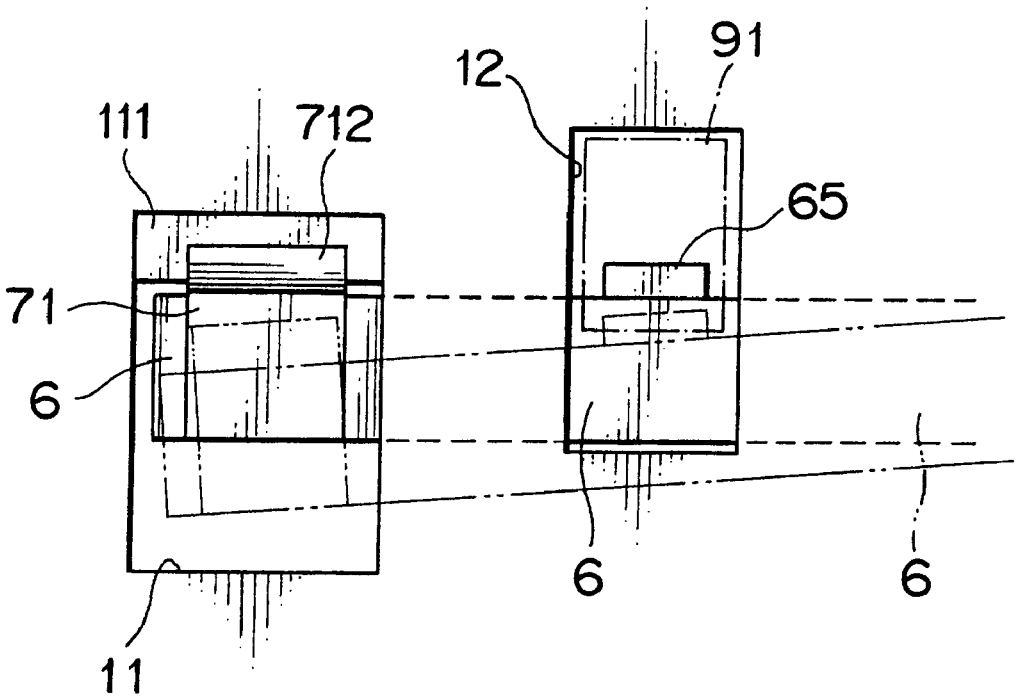
FIG. 15 is a partially enlarged schematic illustration of a principal part in the assembled state.
Figure 16:
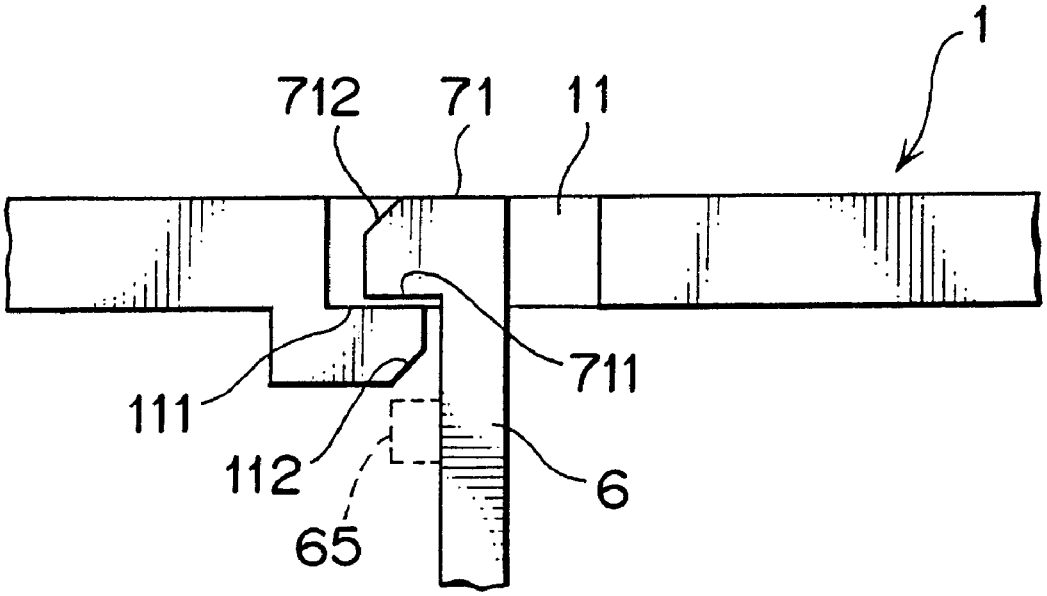
FIG. 16 is a partially enlarged schematic illustration of a principal part in the assembled state.

The members 6, 6 represent flexible plates, each of which extends from the rib 531 into the hollow portions 55. Each flexible plate 6 is provided with teeth 7, 7 which are located at the two widthwise ends of the flexible plate and protruding therefrom. According to the present embodiment, the flexible plates 6, 6 project into the hollow portions 55, which extend vertically as viewed in FIG. 4, perpendicularly to the rib 531. It is needless to say however, that the flexible plates 6, 6 may be so formed as to project from the cylindrical body 51 (See FIG. 7). It is desirable that the flexible plates 6, 6 are disposed to each lateral end of the rib 531, and vertically extend therefrom as viewed in FIG. 4 so that a total of four flexible plates are provided, the upper flexible plates 61 desirably extending parallel to each other, and the lower flexible plates 62 desirably extending parallel to each other. Therefore, the further the parts of the flexible plates 6, 6 are from their respective bases, i.e. fixed portions 535 at which they are affixed to the rib 531 or fixed portions 536 at which they are affixed to the cylindrical body 51, the more said parts tend to flex. Flexible plates that are capable of flexing to even a greater extent can be provided by disposing nearly L-shaped flexible plates 6 in such a manner as to extend from the cylindrical body 51.

Figure 5:
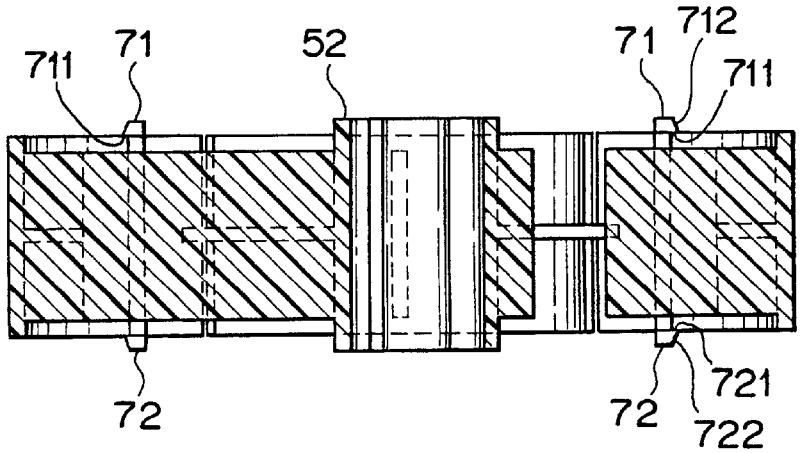
FIG. 5 is a vertical sectional view of FIG. 4 taken along the line V—V.
Figure 6:
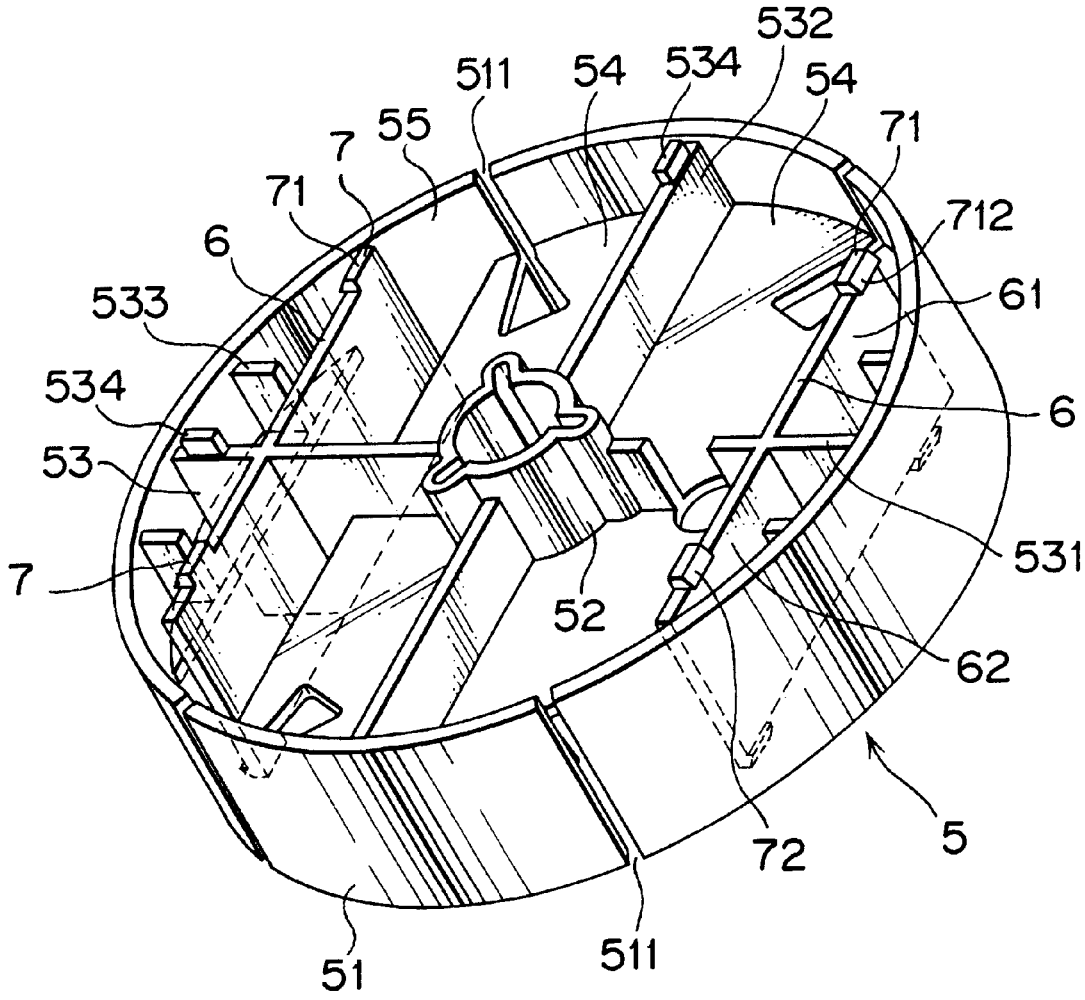
FIG. 6 is a perspective of the reel hub shown in FIG. 4.

With respect to the horizontal direction as viewed in, for example, FIG. 5, tooth-shaped protrusions 71, 72 that serve as the aforementioned teeth 7, 7 are provided on each flexible plate 6 so as to protrude in the same direction (outward as viewed in the drawing) and arranged in such a manner that their positions are different depending on whether they are on the front end or the back end. In cases where the tooth-shaped protrusion 71 on the front end, i.e. the end of the reel hub 5 adjacent to the front flange 1A, is located at the end of the flexible plate 6, the tooth-shaped protrusion 72 at the back end of the reel hub 5, i.e. the end adjacent to the back flange 1B, is located closer to the base of the flexible plate 6 by a distance equivalent to the length of the tooth. Although the tooth-shaped protrusion 71 and the tooth-shaped protrusion 72 of each flexible plate are located at different distances from the base of their flexible plate according to the present embodiment, there will be no problem if they are arranged at the same distance from the base end. Further, a convenient structure may be formed by providing the flexible plates 61 at one side of the rib 531 and the flexible plates 62 at the other side of the rib 531, and arranging the tooth-shaped protrusions 71, 72 in such a manner that the tooth-shaped protrusions 71 protrude in one direction from the flexible plates that are located at one side of the rib 531 and in the opposite direction from the other ends of the flexible plates that are located at the other side of the rib 531 and that each respective tooth-shaped protrusion 72 protrudes in the direction opposite the direction in which the tooth-shaped protrusion 71 that is formed on the opposite end of the flexible plate on which said tooth-shaped protrusion 72 is formed. Stopper faces 711, 721 of the respective tooth-shaped protrusions 71, 72 may conveniently be formed at the same height as the height of the rim of the corresponding side of the cylindrical body 51. It is also convenient to provide each flexible plate 6 with a pushing protrusion 65, which is formed on the side from which the tooth-shaped protrusions 71, 72 protrude. It is desirable that each pushing protrusion 65 is formed at the approximate center of the width (the height as viewed in FIG. 6) of the flexible plate 6. It may be formed in a slanted shape so it slopes upwards in the direction of the center.

Stopper portions 11, 11, 11, 11 are so formed in the flanges 1 as to permit the tooth-shaped protrusions 71, 72 to engage therein when the flanges 1 are engaged with the reel hub 5, each stopper portion 11 covering the space in which the corresponding tooth-shaped protrusion will move. It is desirable that stopper faces 111, which permit the stopper faces 711, 721 of the tooth-shaped protrusions 71, 72 to rest thereon, are formed on the inner faces of the stopper portions 11, in other words on the inner sides of the flanges 1. In an alternative configuration, protruding portions 121, which protrude further inward from the inner surfaces of the flanges, may be formed. These protruding portions 121 have to be arranged such that they are free from the danger of abutting against the cylindrical body 51 of the reel hub 5. This is effective in preventing the tops of the tooth-shaped protrusions 71, 72 from protruding out of the flanges 1 when the tooth-shaped protrusions 71, 72 are engaged in the stopper portions 11.

The tooth-shaped protrusions 71, 72 respectively include slanted portions 712, 722. Therefore, when the tooth-shaped protrusions 71, 72 come into contact with and are stopped by the stopper faces 111 of the stopper portions 11, a gap is formed between each tooth-shaped protrusion and the wall of the stopper portion 11. Making said gaps spacious by forming the stopper faces 111 sufficiently wide has a benefit of permitting a hand or a tool to be inserted more easily in order to flexing the flexible plates 6 by means of the tooth-shaped protrusions 71, 72.

It is desirable that the back surfaces of the stopper faces 111 are slanted outward, so as to permit the slanted portion 712, 722 at the top of the tooth-shaped protrusions 71, 72 to respectively slide thereon. Through holes 12, 12, 12, 12 are formed in the flanges I such that each through hole 12 faces a side of the corresponding flexible plate 61 or 62 when the flange 1 in which the through hole 12 is formed is engaged with the reel hub 5 and that each through hole 12 defines a space corresponding to the portion where the flexible plate is flexed. In order to position the flanges and for other purposes, each flange 1 is provided with one or more through holes 13, one of which corresponds to the through hole 8 of the reel hub 5.

Each flange 1 is provided with approximately two to four positioning members 14, 14 in such a manner that the positioning members 14, 14 are either in contact with or near the catching portion 3 of the flange 1 and are located on radial lines extending from the center of the catching portion 3. Each positioning means 14 may consist of, for example, a groove that is formed of two raised portions. Protrusions 534 adapted to respectively engage with the positioning means 14, which may be formed as grooves or the like, are formed on the rib 53. Whether the flanges 1 and the reel hub 5 are respectively provided with the positioning means 14 and the protrusions 534 or vise versa may be selected as desired.

Numeral 9 denotes a disassembly device which includes key bars 91, 91, 91, 91 disposed at locations corresponding to the through holes 12, 12, 12, 12 of the flanges 1 and extending vertically downward from the underside of a plate body 92. Each key bar 91 serves to push and flex a flexible plate 6. Although a simple square bar or a round bar can serve the purpose, it may desirably have a narrow, tapered end or include a slanted portion 911 formed at the inner side. In addition, a step portion 93 adapted to indicate the limit to which the key bar can be inserted may be provided. Instead of vertically extending from the plate body 92, the key bars 91,91, . . . may be formed on a handle portion 94. The handle portion 94 may be affixed to the top of the plate body 92 or, in an alternative structure, removably attached to the plate body 92. Said alternative structure may include through holes formed in the plate body 92 and catching protrusions formed on the handle portion 94, the catching protrusions of the handle portion 94 adapted to be engaged in the through holes of the plate body 92. Numeral 95 denotes a push-rod which may be provided if it is necessary. The push-rod 95 is adapted to be inserted through the handle portion 94 and the plate portion 92 and capable of moving up and down. An abutment piece 951 adapted to come into contact with the center cylinder 52 of the reel hub is disposed at the end of the push-rod 95 as a separate member or an integral body with the push-rod.

Next, the procedure for assembling a reel is explained hereunder. First, the flanges 1A, 1B are brought into contact with both ends of the reel hub 5; the through hole 13 for positioning is aligned with the through hole 8 of the reel hub 5; and the through holes 4, 4 of the respective flanges 1A, 1B are aligned with the center cylinder 52 of the reel hub 5 so that the tooth-shaped protrusions 71, 72 face the stopper portions 11, 11, 11, 11. In this state, the flanges 1A, 1B are pressed hard against the reel hub 5. This pressing may be done by stacking the flange 1A, the reel hub 5 and the flange 1B one atop another and pressing the stack against a stand or a side plate.

At that time, the flexible plates 6 of the reel hub 5 are pushed and flexed, because the slanted portions 712, 722 of the tooth-shaped protrusions 71, 72 slide on and push the slanted portions 112 of the stopper faces 111 of the stopper portions 11, 11,. . . When the tooth-shaped protrusions 71, 72 have passed the slanted portions 112, the flexible plates 6 bounce back due to their elasticity so that the slanted portions 712, 722 of the tooth-shaped protrusions 71, 72 come to rest on the stopper faces 1 11, 11, . . . of the stopper portions 11, 11, . . . At the same time, the cylindrical body 51 of the reel hub 5 is fitted to the reel hub catching portions 3 of the flanges 1A, 1B while the center cylinder 52 becomes fitted in the through holes 4 of the flanges 1A, 1B. As the center cylinder 52 of the reel hub protrudes slightly out of the two opposing ends of the cylindrical body 51 in the same manner as the tooth-shaped protrusions 71, 72 do, it is needless to say that the engagement described above is conducted smoothly, without the danger of the reel hub protruding out of the flanges 1A, 1B. Furthermore, the presence of the catching portions 3 of the flanges 1 ensures reliable engagement as they become fitted to the cylindrical body 51 of the reel hub 5 and thereby preventing inadvertent dislocation or revolution of the reel hub. In cases where positioning means 14, 14, . . . and protrusions 534, 534, . . . are provided, their engagement ensures more reliable engagement of the flanges and the reel hub by reliably preventing revolution of the reel hub.

Thus, the assembly of the flange 1A, the reel hub 5 and the flange 1B is completed. The assembled reel may be used in a manner well known to those skilled in the art and, after use, may be disassembled.

When disassembling a reel a user may, hold a disassembly device 9 at its handle portion 94 and insert the key bars 91, 91 . . . into the through holes 12, 12, . . . of the flanges 1. The inner side of the end portion of each key bar 91 is tapered into a slanted portion 911. Therefore, when the key bars 91, 91 . . . are inserted, their slanted portions 911 come into contact with the outer faces of the flexible plates 6 and thereby flex the flexible plates. At that time, movement of the key bars 91, 91 . . . is directed with one side of each key bar being in contact with a rib 533 extended from the cylindrical body 51. The key bars 91, 91 . . . continue to advance until they push the protrusions 65, 65, . . . at the respective centers of the flexible plates 6, thereby flexing them to the maximum degree.

The key bars 91, 91 . . . are not always necessary; the tooth-shaped protrusions 71, 72 which are engaged with the stopper faces 111, 111, . . . of the stopper portions 11, 11, . . . can be separated from the stopper faces 111, 111 . . . by pushing the tooth-shaped protrusions 71, 72 with the hand, a hook or other suitable tools to cause flexing of the flexible plates 6 in such a direction as to disengage the tooth-shaped protrusions.

As a result, the stopper faces 711, 721 of the tooth-shaped protrusions 71, 72 become disengaged from the stopper faces 111, 111, . . . so that the outer flange 1A begins to be separated from the reel hub 5. Meanwhile, the stopper faces 711, 721 of the tooth-shaped protrusions 71, 72, which engage the flange 1B associated with the reel hub 5, too, become disengaged from the stopper faces 111, 111, . . . However, each key bar 91 is still sandwiched between the corresponding flexible plate 6 of the reel hub 5 and the corresponding rib 533. In this state, the key bars 91, 91, . . . can easily be removed by hand but will stay as they are if they remain untouched. When the push-rod 95 is pushed in that state, the push-rod 95 pushes only the center cylinder 52 of the reel hub 5 and advances together with the flange 1B. However, as they are released from the engagement at the time when the push-rod 95 is pushed forward, the reel hub 5 and the flange 1B, too, become detached from each other.

According to the invention as described above, the reassemblable reel is broadly comprised of two flanges, and a reel hub which includes flexible plates formed therein, wherein each flexible plate is provided with tooth-shaped protrusions respectively formed on the front and back ends of the flexible plate and protruding therefrom; the reel is so designed as to be formed by bringing the flanges into contact with both ends of the reel hub and pushing the flanges so that the elasticity of the flexible plates engages the tooth-shaped protrusions with stopper portions formed in the flanges; and wherein the tooth-shaped protrusions of each flexible plate can be disengaged by pushing the flexible plate from the outside of either flange in such a direction as to disengage the tooth-shaped protrusions. Therefore, the reel can easily be assembled with no need of equipment or a tool but simply by pushing by hand. Disassembly of the reel is also easy, because the flanges can easily be removed from the reel hub by pushing, by hand or with a tool, the flexible plates via the tooth-shaped protrusions from the direction of either flange so as to disengage the tooth-shaped protrusions.

Also, according to the invention as described, a reassemblable reel is comprised of two flanges and a reel hub which includes flexible plates formed therein, wherein each flexible plate is provided with tooth-shaped protrusions respectively formed on the front and back ends of the flexible plate and protruding therefrom; the reel is so designed as to be formed by bringing the flanges into contact with both ends of the reel hub and pushing the flanges so that the elasticity of the flexible plates engages the tooth-shaped protrusions with stopper portions formed in the flanges; and wherein key bars adapted to push the flexible plates in such a direction as to disengage their tooth-shaped protrusions are so provided as to be removably inserted into through holes formed in the flanges. Therefore, the reel can be disassembled in an instant, because both flanges can be disengaged and removed from the reel hub with a single action, i.e., by insertion of the key bars.

The cylindrical body of the reel hub can be engaged with the flanges securely without the danger of inadvertent dislocation or revolution of the flanges or the reel hub. Thus, reliable and firm engagement can be ensured by an extremely simple configuration.

By the use of a conductive material, the invention ensures reliable protection of components or other goods stored in a reel according to the invention.

A disassembly device according to the invention ensures easy separation of the flanges and the reel hub by means of insertion of the key bars of the disassembly device. Further, in cases where a disassembly device includes a push-rod, the reel can be disassembled in an instant with a single action. When being transported and/or stored after use, the space taken by the reels can drastically be reduced because they can be disassembled into flanges which are in the shape of a flat plate and can be stacked, and reel hubs which have a small diameter. Thus, the invention is effective in substantially reducing transportation and storage costs.

What is claimed is:

1. A reassemblable reel comprising two flanges and a reel hub, said reel hub comprising an inner generally cylindrical body and an outer generally cylindrical body with at least one supporting rib extending between said inner and outer generally cylindrical bodies, and flexible plates positioned in the space between said inner and outer generally cylindrical bodies in association with said at least one supporting rib, wherein each flexible plate is provided with at least one tooth-shaped protrusion protruding from opposed ends of said reel hub, and the flanges include stopper portions formed therein, such that the reel is formed by bringing the flanges into contact with both ends of the reel hub and applying a pushing force on the flanges, thereby forcing engagement of the at least one tooth-shaped protrusion with a stopper portion formed in the flanges; and wherein the at least one tooth-shaped protrusion of each flexible plate can be disengaged by pushing the flexible plate from the outside of either flange in such a direction as to disengage the tooth-shaped protrusions.

2. A reassemblable reel and associated disassembly device, said reel comprising two flanges and a reel hub which includes an inner generally cylindrical body and an outer generally cylindrical body with at least one supporting rib extending between said inner and outer generally cylindrical bodies, and flexible plates positioned in the space between said inner and outer generally cylindrical bodies in association with said at least one supporting rib, wherein each flexible plate is provided with at least one tooth-shaped protrusion respectively formed on the flexible plate and protruding therefrom; said flanges having stopper portions, such that the reel is formed by bringing the flanges into contact with both ends of the reel hub and pushing the flanges into engagement with the tooth-shaped protrusions with the stopper portions formed in the flanges; and wherein said disassembly device comprises key bars which are selectively used to push the flexible plates in such a direction as to disengage said tooth-shaped protrusions, said key bars being removably inserted into through holes formed in the flanges.

3. A reassemblable reel as claimed in claim 1 or claim 2, wherein a catching portion is formed on a central part of the inner face of each flange, the catching portion protruding from the flange to permit a cylindrical body of the reel hub to fit thereto.

4. A reassemblable reel as claimed in any one of the claims from claim 1 or claim 2, wherein each flange is provided with positioning portions which are disposed on radial lines extending from the center of the catching portion and are located in a region between contacting the catching portion to a position adjacent the catching portion, the positioning portions so formed as to permit stopper protrusions formed on ribs of the reel hub to be engaged therewith.

5. A reassemblable reel as claimed in any one of the claims from claim 1 wherein the two flanges and the reel hub are formed of a conductive synthetic resin.

6. A reassemblable reel as defined in claim 1 or 2 wherein the two flanges and reel hub are formed of a conductive synthetic resin.

7. A reassemblable reel comprising two flanges and a reel hub, wherein said reel hub includes at least one first protrusion extending from opposed ends of said reel hub, and wherein said flanges have stopper portions formed therein, such that the reel is formed by bringing the flanges into contact with both ends of the reel hub and pushing the flanges into engagement with the at least one first protrusion protruding from the ends of the reel hub to engage the at least one first protrusion with a stopper portion formed in the flange, wherein each flange is provided with at least one positioning portion which is disposed on radial line and located in a region between the center of the flange to the circumference, the at least one positioning portion formed so as to permit at least one stopper protrusion formed on the reel hub to be engaged therewith.

* * * * *